United States Patent [19]

Kopp

[11] Patent Number: 4,627,551

[45] Date of Patent: Dec. 9, 1986

[54] DISPENSER SYSTEM AND METHOD FOR DISPENSING PUTTY-LIKE MATERIAL

[75] Inventor: Raun A. Kopp, Brunswick, Ohio

[73] Assignee: Oatey Co., Cleveland, Ohio

[21] Appl. No.: 586,118

[22] Filed: Mar. 5, 1984

[51] Int. Cl.[4] ..... B65D 35/28

[52] U.S. Cl. ..... 222/1; 222/102; 222/107

[58] Field of Search ..... 222/1, 102, 107, 92, 222/95, 99, 101, 105, 181; 251/10

[56] References Cited

U.S. PATENT DOCUMENTS

| | | | |
|---|---|---|---|
| 1,244,205 | 10/1917 | Heck | 251/10 |
| 1,250,985 | 12/1917 | Day | 251/10 |
| 1,845,291 | 2/1932 | Koontz | 222/102 |
| 2,179,012 | 11/1939 | Kach | 222/102 |
| 3,142,074 | 7/1964 | Reich | 222/102 |
| 3,265,249 | 8/1966 | Jansson | 222/460 |
| 3,581,943 | 6/1971 | Koenigshof | 222/102 |
| 3,701,459 | 10/1972 | Ward | 222/102 |
| 3,815,794 | 6/1974 | Carlisle | 222/107 |
| 4,205,764 | 6/1980 | Gill | 222/105 |
| 4,231,492 | 11/1980 | Rios | 222/95 |
| 4,261,482 | 4/1981 | Yamada et al. | 222/107 |

FOREIGN PATENT DOCUMENTS

| | | | |
|---|---|---|---|
| 0463370 | 2/1950 | Canada | 222/102 |
| 2409206 | 7/1979 | France | 222/102 |
| 315660 | 7/1929 | United Kingdom . | |
| 593829 | 10/1947 | United Kingdom . | |
| 722969 | 11/1952 | United Kingdom . | |
| 832688 | 7/1956 | United Kingdom . | |
| 898641 | 7/1958 | United Kingdom . | |
| 1044036 | 5/1963 | United Kingdom . | |
| 1007657 | 7/1963 | United Kingdom . | |
| 1002315 | 8/1963 | United Kingdom . | |
| 1029489 | 12/1964 | United Kingdom . | |
| 2075950 | 5/1980 | United Kingdom . | |

*Primary Examiner*—Joseph J. Rolla
*Assistant Examiner*—Michael S. Huppert
*Attorney, Agent, or Firm*—Renner, Otto, Boisselle & Lyon

[57] ABSTRACT

Dispenser system includes a pair of squeeze rollers for squeezing putty-like material from a bag-like container as the container is pulled between the rollers during turning of the rollers in opposite directions. Each of the squeeze rollers has a rubber-like cover whereby the rollers may be compressed together to ensure that the rollers will frictionally grip opposite sides of the bag passing therebetween to uniformly pull the bag between the rollers during turning of the rollers to squeeze the material out of the container. The container itself is preferably made from two flat sheets of plastic material which may be joined together by heat sealing. The two sheets are initially laid flat one on top of the other and heat sealed along the side edges and bottom which is formed into a funnel-shaped spout. The top is left open to permit filling of the container with the desired quantity of putty-like material. After filling, the top of the container is heat sealed a short distance from the top edge to provide an extension thereat to assist in starting the container between the rollers.

7 Claims, 6 Drawing Figures

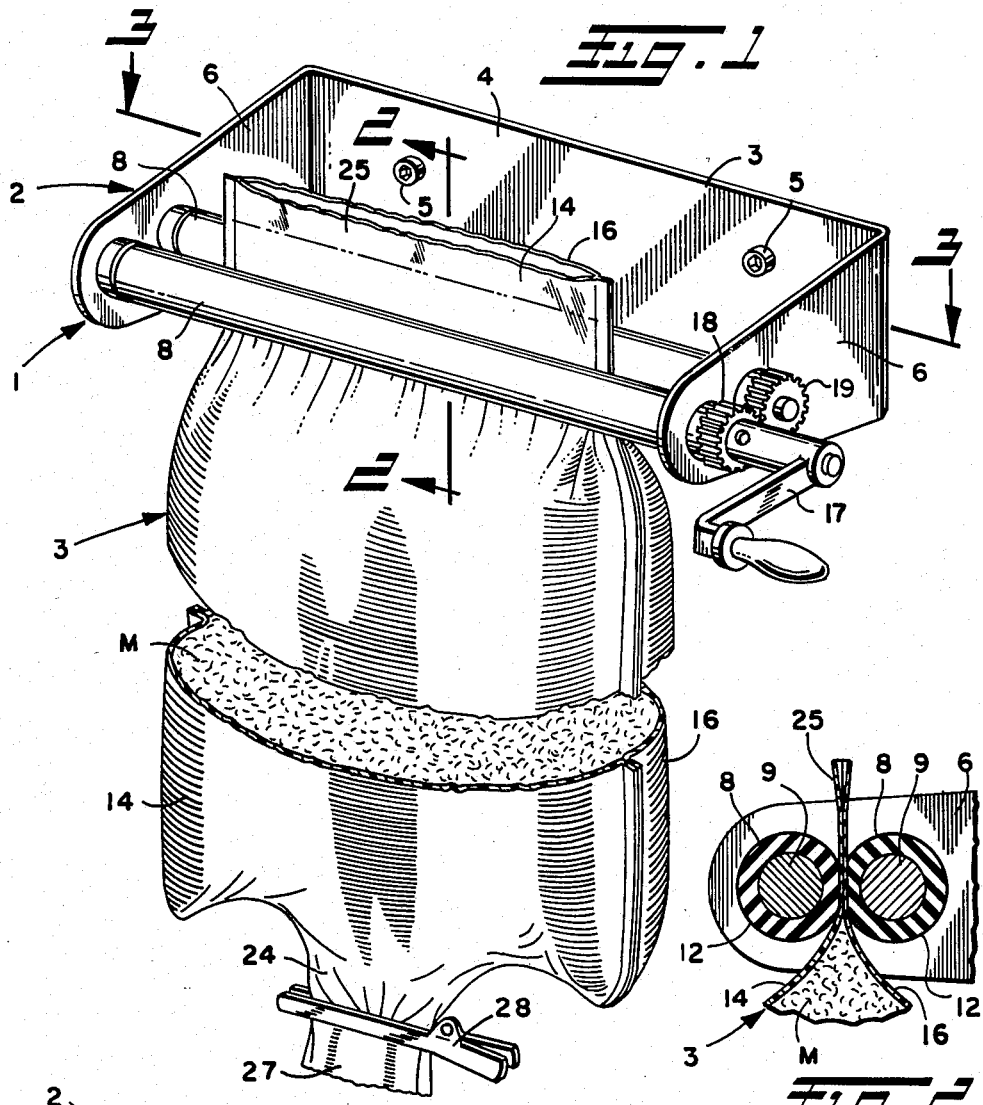
FIG. 1
FIG. 2
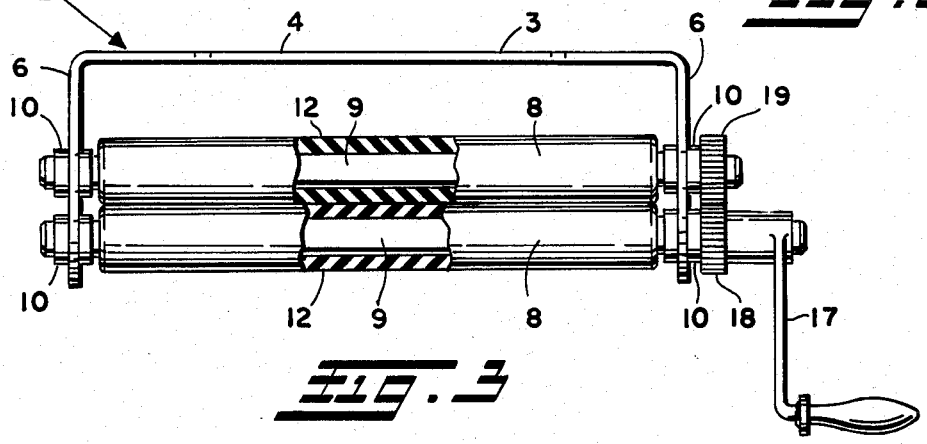
FIG. 3

DISPENSER SYSTEM AND METHOD FOR DISPENSING PUTTY-LIKE MATERIAL

BACKGROUND OF THE INVENTION

This invention relates generally as indicated to a dispenser system and method for dispensing putty-like material from a flexible bag-like container by pulling the container upwardly between a pair of squeeze rollers.

The advantages in using flexible bag-like containers for storing and shipping putty-like material are already known. Such containers are relatively inexpensive and lightweight and can readily be stacked and shipped in varying numbers in cartons of varying sizes with little danger of damage to the containers and putty-like material contained therein, and none of the denting problems which oftentimes occur when metal containers are used for the putty-like material.

It is also generally known to dispense the material as needed directly from the same bag-like container used to ship and store the material. One type of dispenser that has been effectively used for dispensing putty-like material directly from such a bag-like container is disclosed in U.S. Pat. No. 4,231,492, owned by the same assignee as the present application.

A disadvantage in using a dispenser of the type shown in U.S. Pat. No. 4,231,492 is that it requires an air pressure source for operating the dispenser. Also, because of the manner in which pressure is applied to the container using a push plate, it is normally not possible to dispense all of the material from the container. Moreover, the operator never knows when the dispenser needs refilling until he actually finds that no more material can be dispensed from the dispenser.

Another disadvantage of this type of dispenser is that it is somewhat time consuming to remove the old container from the dispenser and replace it with a new one. Moreover, several of the dispenser parts such as the flow control valve and possibly the push plate as well as other parts of the dispenser may become contaminated by the putty-like material thus necessitating occasional cleaning. In addition, the dispenser apparatus itself is relatively expensive.

SUMMARY OF THE INVENTION

With the foregoing in mind, it is a principal object of this invention to provide a dispenser system and method for dispensing putty-like material which do not require an air pressure source for operation, allow the operator always to see just how much material remains to be dispensed, and minimize the amount of time required to refill the dispenser with a new supply of putty-like material.

Another object is to provide such a dispenser system and method which maximize the amount of material that can be dispensed from each container of putty-like material.

Still another object is to provide such a dispenser system which is relatively inexpensive to manufacture and is extremely simple to operate.

Yet another object is to provide such a dispenser system and method in which the rate at which the putty-like material is dispensed can readily be controlled.

These and other objects of the present invention may be achieved by providing a dispenser system including a pair of squeeze rollers for squeezing the putty-like material from a flexible bag-like container having a funnel shaped spout at the bottom through which the material is dispensed as the container is pulled upwardly between the squeeze rollers. The squeeze rollers preferably have a rubber-like outer cover which permits the rollers to be compressed together to ensure that the rollers will frictionally grip the opposite sides of the container and uniformly pull the container between the rollers during turning of the rollers in opposite directions to squeeze substantially all of the material out of the container.

The container itself is desirably made from two flat sheets of a suitable plastic material which may be joined together by heat sealing. The two sheets are initially laid flat one on top of the other and heat sealed along the side edges and along the bottom which is formed into the desired funnel shape. The top of the container is initially left open for subsequent filling with the desired amount of putty-like material. After filling, the top of the container is also desirably heat sealed a short distance from the top edge to provide a relatively flat extension at the top to assist in starting the container between the rollers.

Once the top of the container is frictionally engaged by the rollers, the lowermost heat sealed edge of the funnel shape spout may be cut off using a scissors or the like. Then the rollers may be turned to pull the container up between the rollers to squeeze the material out through the funnel shape spout. A spring clip may be used to pinch off the funnel shape spout to prevent the material from dripping from the container when the dispenser is not in use.

Other objects and advantages of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 1 is a perspective view, partially broken away, of a preferred form of dispenser system in accordance with this invention;

FIG. 2 is a fragmentary transverse section through the squeeze rollers and bag-like container which comprise the dispenser system of the present invention, taken on the plane of line 2—2 of FIG. 1;

FIG. 3 is a top plan view of the hand crank dispenser for the dispenser system as seen from the plane of the line 3—3 of FIG. 1, with portions of the squeeze rollers broken away to show the rubber-like roller covers;

DETAILED DESCRIPTION OF THE PREFERRED EMBODIMENT

Figure 4:
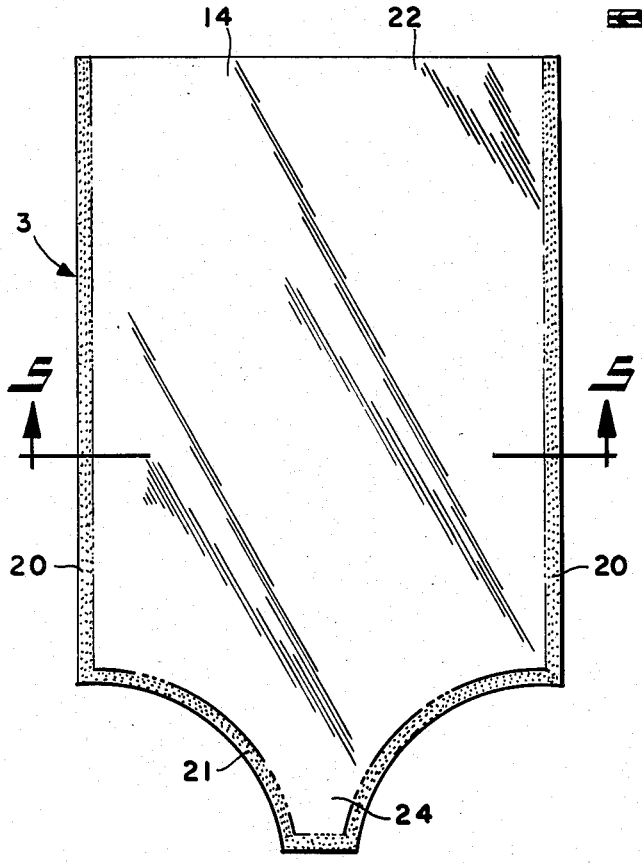
FIG. 4 is a side elevation view of the preferred configuration of the bag-like container for the putty-like material shown before filling with the putty-like material.

Referring now in detail to the drawings, and initially to FIG. 1, a preferred form of dispenser system in accordance with this invention is generally indicated by the reference numeral 1, and includes a hand crank dispenser 2 and a specially configured bag-like container 3 for the putty-like material M to be dispensed therefrom. The hand crank dispenser 2 includes a dispenser frame 3 which is desirably generally U-shape including a substantially flat back wall member 4 which may be attached to a wall or other mounting surface using suitable fasteners 5, and a pair of arm members 6 extending outwardly from opposite ends of the back wall member for mounting of a pair of squeeze rollers 8 therebetween.

Referring further to FIG. 1 and also to FIGS. 2 and 3, the squeeze rollers 8 may be made from metal dowel rods 9, with suitable bearings 10 at opposite ends thereof to permit journal mounting of the ends of the rods within the arm members 6 for rotation as shown. Extending over the dowel rods between the end bearings are rubber-like tubular sleeves or covers 12 which provide the desired frictional contact with opposite sides of the bag-like container 3 for pulling the container therebetween as described hereafter.

As best seen in FIGS. 2 and 3, the outer surfaces of the roller covers 12 are preferably somewhat compressed together to increase the frictional contact with the opposite sides 14, 16 of the bag-like container. Although different types of materials having different hardnesses may be used for the roller covers, one such roller cover material that has been found particularly effective is Neoprene having a Shore A Durometer hardness of 45±5. Also, while the amount of compression or preload of the roller covers may be varied within certain limits, it has been found that rollers made from $\frac{5}{8}$ inch diameter dowel rods with $1\frac{1}{2}$ inch diameter covers thereon should desirably be compressed together approximately 0.050 inch each to provide the gripping necessary to pull the bag-like container between the rollers and squeeze substantially all of the putty-like material therefrom during turning of the rollers in opposite directions.

Preferably, a hand crank 17 is provided at one end of one of the rollers 8 for turning same. Simultaneous turning movement of the other roller in the opposite direction may be obtained by providing gears 18, 19 on the same ends of the rollers in meshing engagement with each other. As explained in greater detail hereafter, the reason for positively driving both rollers is to ensure that both sides of the container are advanced at a uniform rate between the rollers so that the sides of the container are flattened out to the original flat shape shown in FIGS. 4 and 5 as the container passes between the rollers to maximize the amount of material that is squeezed out of the container.

Figure 5:
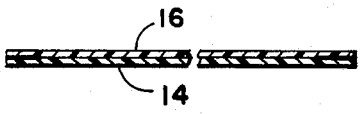
FIG. 5 is a fragmentary transverse section through the bag-like container of FIG. 4, taken on the plane of the line 5—5 thereof.
Figure 6:
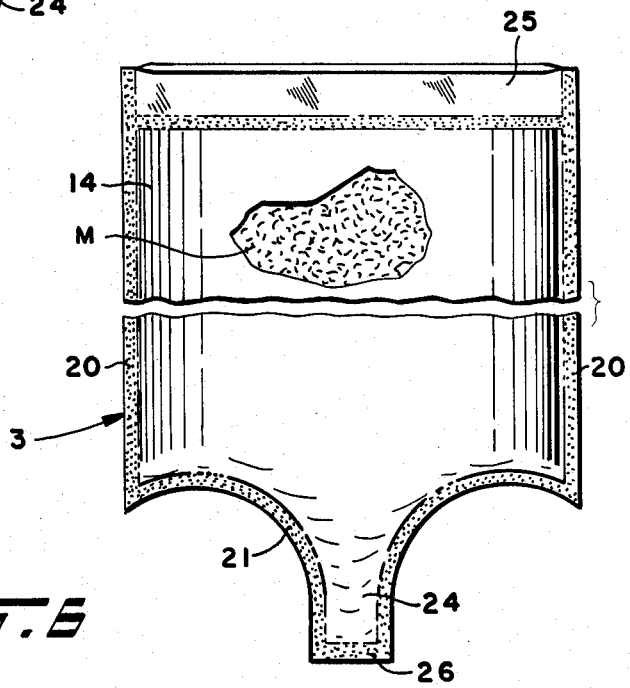
FIG. 6 is a fragmentary side elevation view, with portions broken away, showing the bag-like container of FIG. 4 after it has been filled with the putty-like material through the top open end thereof and the top has been sealed.

Referring further to FIGS. 4 and 5, the bag-like container 3 itself is desirably made from two flat sheets 14, 16 of a suitable plastic material which may be joined together by heat sealing. Initially the two sheets are laid flat one on top of the other and heat sealed along their side edges 20 and bottom 21 with the top 22 left open for subsequent filling with the desired quantity of putty-like material which typically may be 2 to 5 gallons. The bottom 21 of the container is desirably heat sealed in such a fashion that the bottom edge gradually slopes downwardly from each side 20 to a funnel shape spout 24 which is desirably located substantially at the bottom center of the container. After filling, the top of the container is also preferably heat sealed a short distance from the top edge, for example, $\frac{1}{2}$ inch to 1 inch from the top edge, to provide a relatively flat extension 25 at such top edge as shown in FIG. 6 for a purpose to be subsequently described.

The filled bag-like containers can readily be stacked and shipped in varying numbers in cartons of varying sizes, with little danger of damage, and none of the denting problems which oftentimes occur when metal containers are used for the putty-like material. Moreover, the filled plastic containers require much less room for storage and can be stored for significant lengths of time without fear of operational problems caused by solvent separation from the putty-like material during storage since the putty-like material can readily be mixed and redistributed immediately before use by kneading the material in the plastic containers to effect such redistribution without having to open the containers.

To dispense the putty-like material, a container filled with the material is held beneath the rollers with the extension 25 at the upper end of the container centered lengthwise of the rollers and inserted between the engaging roller surfaces. Then the hand crank is rotated in a counterclockwise direction as viewed from the right end of FIG. 1 to cause the container extension to be frictionally gripped by the rollers and pulled up between the rollers to the position shown in FIGS. 1 and 2. At that point, the frictional drag between the rollers 8 and gears 18, 19 as well as the frictional engagement of the rollers with opposite sides of the container will be sufficient to enable the weight of the container to be supported by the rollers without having to hold either the container or crank. This frees up the operator's hands to enable him to cut off the lowermost heat sealed end 26 of the funnel shaped spout 24 of the container using a scissors or the like.

Now the dispenser system is ready for use in dispensing putty-like material from the container simply by rotating the hand crank to pull the container up between the rollers which applies a squeezing force on the material in the container and forces the material out through the funnel shape spout. As the container moves up between the rollers, the sides 14, 16 of the container are substantially flattened out to their original flat shape illustrated in FIGS. 4 and 5, whereby substantially all of the material is squeezed out from the container as the container passes between the rollers. Also, very little if any of the putty-like material will be trapped in the bottom corners of the container as the bottom of the container passes between the rollers because of the gradual downwardly sloping edges of the bottom which aid in the flow of the putty-like material out through the spout.

The provision of the funnel shape spout 24 at the bottom of the container also has the advantage that the size of the discharge opening 27 may readily be controlled by controlling the width of the spout during manufacture of the container to control the rate of flow of the putty-like material from the container as the material is dispensed therefrom. Also, the rate of discharge of material from the container may be varied by varying the rate at which the rollers are turned by the hand crank which varies the amount of pressure applied to the material within the container.

The provision of a funnel shape spout has the further advantage that it provides a relatively narrow extension to the discharge opening 27 which can readily be pinched off using a spring clip 28 such as shown in FIG. 1 to ensure against dripping of the material from the container between dispensing operations. As evident from FIG. 1, the spring clip is open at one end to permit insertion and removal of the spring clip from the side of the spout using one hand.

From the foregoing, it will be appreciated that with such a dispenser system, the operator can readily control the rate at which material is dispensed from the container simply by varying the rate at which the rollers are turned to vary the squeezing force on the material contained in the container. Also, the operator can visually observe when the container is substantially empty, and can easily remove the old container simply by continuing to turn the rollers until the bottom of the old container passes up through the rollers. The extension at the top edge of a new container may then be started between the rollers and the sealed bottom of the spout cut-off to provide the dispenser system with a new supply of material in the manner previously described.

Although the invention has been shown and described with respect to a certain preferred embodiment, it is obvious that equivalent alterations and methods will occur to others skilled in the art upon the reading and understanding of the specification. The present invention includes all such equivalent alterations and modifications and is limited only by the scope of the claims.

The embodiments of the invention in which an exclusive property or priviledge is claimed are defined as follows:

1. A dispenser system for dispensing putty-like material comprising flexible bag-like container means of a size for holding at least approximately two gallons of putty-like material, and a pair of squeeze roller means for squeezing the putty-like material from said container means, said container means being made from two flat plastic sheets placed one on top of the other to form opposed flat sides which are heat sealed along the side edges, top and bottom, said bottom being heat sealed to form a funnel shape spout, the lowermost heat sealed edge of said funnel shape spout being cut off to provide a discharge opening at the bottom of said spout for discharging the material from said container means as said container means is pulled upwardly between said roller means, a hand crank attached to one of said roller means for turning one of said roller means, ratchet-less gear means between said roller means for driving the other of said roller means in unison with said one roller means but in the opposite direction in response to turning movement of said one roller means in one direction, said roller means having rubber-like cover means thereon having a Shore A Durometer hardness of 45±5 which are compressed against each other approximately 0.050 inch each for frictionally gripping opposite sides of said container means when said container means is inserted therebetween with sufficient force to support the entire weight of said container means when filled with at least approximately two gallons of such putty-like material without any external force being applied to said roller means or crank, and for pulling said container means upwardly between said roller means without slippage upon turning said crank in such one direction by hand and substantially flattening out the sides of said container means to squeeze out substantially all of the putty-like material from between said sides as said sides pass upwardly between said roller means.

2. The dispenser system of claim 1 wherein said rubber-like cover means are compressed against each other with sufficient force that such roller means will support the entire weight of said container inserted therebetween when filled with two to five gallons of said putty-like material and still allow said container means to be pulled upwardly between said roller means upon turning said crank in such one direction by hand.

3. The dispenser system of claim 1 wherein said roller means have a metal rod for supporting said rubber-like cover means thereon, said rubber-like cover means being in the form of tubular sleeves which are inserted onto said rods from one end.

4. The dispenser system of claim 1 wherein the top of said container means is heat sealed a distance of at least approximately one-half inch from the top edge of said container means after said container means has been filled with such putty-like material to provide a relatively flat top extension to assist in starting the top of said container means between said roller means.

5. The dispenser system of claim 1 further comprising a spring clip for pinching off said spout between dispensing operations, said spring clip being open at one end to permit insertion over said spout and removal therefrom from the side of said spout using one hand.

6. A method of dispensing putty-like material from a flexible bag-like container of a size for holding at least approximately two gallons of the putty-like material, such container having a funnel shape spout at the bottom of such container, comprising the steps of inserting the top edge of the container between a pair of squeeze rollers, cutting off the bottom of the funnel shape spout to provide a discharge opening therein, and rotating the squeeze rollers in opposite directions to pull the container upwardly between the squeeze rollers thereby squeezing the putty-like material from the container through the discharge opening in the bottom of the funnel shape spout, the container being made from two flat plastic sheets placed flat one on top of the other to form opposite flat sides and heat sealed along the side edges and top and bottom, with the bottom being heat sealed to form the funnel shape spout, and the top of the container being heat sealed a distance of at least approximately one-half inch from the top edge after the container has been filled with such putty-like material to provide a relatively flat top extension thereat to assist in starting the top of the container between the squeeze rollers, one of the squeeze rollers having a hand crank attached thereto for turning the one squeeze roller by hand, and ratchetless gear means between the squeeze rollers for turning the other squeeze roller in the opposite direction in response to turning movement of the one squeeze roller in one direction, the squeeze rollers having rubber-like covers having a Shore A Durometer hardness of 45±5 which are compressed against each other approximately 0.050 inch each for frictionally gripping opposite sides of the container with sufficient force to support the entire weight of the container when filled with at least approximately two gallons of the putty-like material without any external force being applied to the rollers or crank, and to pull the container upwardly between the squeeze rollers without slippage upon turning the crank in such one direction by hand to substantially flatten out the sides of the container and squeeze out substantially all of the putty-like material from between the sides as the sides pass upwardly between the rollers.

7. The method of claim 6 wherein the bottom of the container gradually slopes downwardly from each side edge to the funnel shape spout, and the funnel shape spout is located substantially at the bottom center of the container and has a relatively narrow bottom extension to the discharge opening, further comprising the steps of inserting a spring clip having an open end over the spout from the side using one hand to pinch off the spout to insure against dripping of material from the funnel shape spout between dispensing operations and removing the spring clip from the side prior to the next dispensing operation.

* * * * *